US006035480A

United States Patent [19]

Pianetti

[11] Patent Number: 6,035,480

[45] **Date of Patent: *Mar. 14, 2000**

[54] TOOTHBRUSH SUITABLE FOR PREVENTING THE FORMATION OF DENTAL PLAQUE AND OF TARTAR

[76] Inventor: Francesco Pianetti, Via Turati 22, 20013 Magenta, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/997,122

[22] PCT Filed: Jun. 24, 1996

[86] PCT No.: PCT/EP96/02730

§ 371 Date: Dec. 23, 1997

§ 102(e) Date: Dec. 23, 1997

[87] PCT Pub. No.: WO97/01297

PCT Pub. Date: Jan. 16, 1997

[30] Foreign Application Priority Data

Jun. 28, 1995 [IT] Italy ..... MI95U0451

[51] Int. Cl.[7] ..... A46B 9/02; A46B 9/04

[52] U.S. Cl. ..... 15/167.1; 15/143.1; D4/104

[58] Field of Search ..... 15/167.1, 167.2, 15/160, 171, 143.1, 159.1; D4/104, 105, 112, 106, 138

[56] References Cited

U.S. PATENT DOCUMENTS

| | | | |
|---|---|---|---|
| 2,161,349 | 6/1939 | Hadden | 15/167.1 |
| 3,864,781 | 2/1975 | Leonard | 15/167.1 |
| 5,499,421 | 3/1996 | Brice | 15/167.1 |

FOREIGN PATENT DOCUMENTS

| | | | |
|---|---|---|---|
| 346783 | 12/1927 | Belgium . | |
| 528868 | 11/1921 | France . | |
| 2951284 | 7/1981 | Germany . | |
| 3-286708 | 12/1991 | Japan | 15/167.1 |
| 17423 | 6/1896 | United Kingdom | 15/167.1 |
| 247005 | 2/1926 | United Kingdom | 15/167.2 |

*Primary Examiner*—Gary K. Graham
*Attorney, Agent, or Firm*—Hedman, Gibson & Costigan, P.C.

[57] ABSTRACT

The invention refers to a toothbrush having anti-dental plaque and anti-tartar activity, characterised in that its bristle-carrier zone (4) is misaligned to the handle (1), a first side of said handle is aligned to the relevant side of said bristle-carrier zone and the second side of said handle has an undercut (3) bounding a recessing portion (2), said recessing portion being 2 or 3 cm. long.

6 Claims, 1 Drawing Sheet

TOOTHBRUSH SUITABLE FOR PREVENTING THE FORMATION OF DENTAL PLAQUE AND OF TARTAR

The present invention refers to a toothbrush having anti-dental plaque and anti-tartar activity and providing useful features if compared with the toothbrushes known in the art.

In particular, the present invention refers to a toothbrush having a shape and a structure suitable for cleaning the anterior zone of the inferior dental arch to prevent in preventing the formation of dental plaque and of tartar.

It is known that the dental plaque and the tartar generally develop on the anterior zone of internal side of the inferior dental arch. The development of the dental plaque and of the tartar in said denture zone cannot be avoided through the toothbrushes already known in the art as their shape and structure are not suitable for reaching and effectively treating said denture zone.

Furthermore, the internal side of the inferior dental arch is particularly involved in the formation of dental plaque and of tartar as the saliva is always stagnating on said denture zone, where there are many salivary glands.

It is further known that the dental plaque and tartar problem is a very common one, involving more or less quite the whole population. Said problem has been solved by using a toothbrush according to the invention, which is suitable for cleaning the anterior zone of the internal side of the inferior dental arch to prevent the formation of dental plaque and of tartar on the internal side of the inferior dental arch.

BE-A-528,868 discloses toothbrushes suitable for cleaning only a part of the dental arches: two different toothbrushes (or a toothbrush having two different bristle-carrier zones positioned at opposite ends of the handle or positioned side-by-side) must be therefore used for cleaning the whole internal side of the inferior dental arch.

The toothbrush having anti-dental plaque and anti-tartar activity to which the present invention refers is characterised in that its bristle-carrier zone protrudes laterally with reference to a first lateral side of its handle, the bristle-carrier zone and the handle being coplanar, in that the second lateral side of the handle is aligned to the lateral side of the bristle carrier zone positioned on the same side of the toothbrush and in that the first lateral side of the handle has an undercut reaching near the axis of said handle and being 2 or 3 cm. long, beginning from said bristle-carrier zone.

Characterising features and advantages of a toothbrush according to the invention will be better described on the following detailed description with reference to the enclosed FIGS. 1 and 2.

DETAILED DESCRIPTION OF INVENTION

Figure 1:
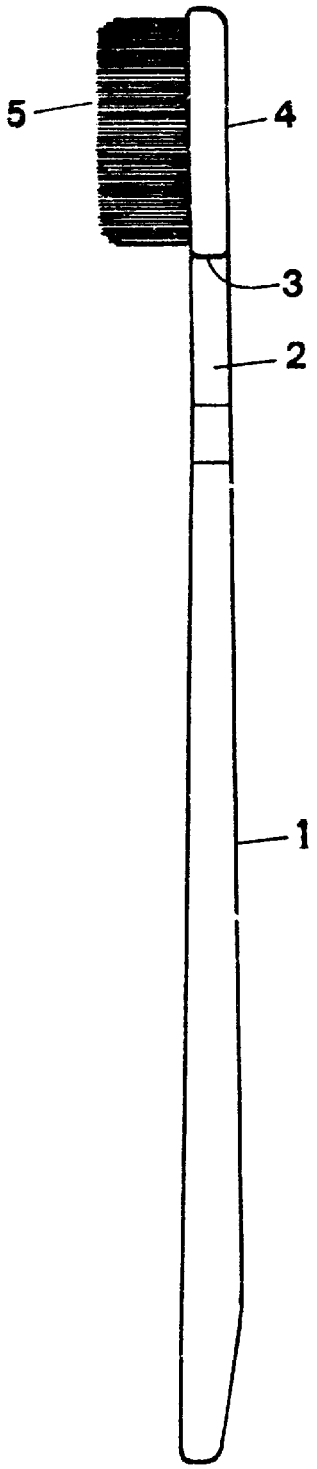
FIG. 1 shows a side view of the toothbrush.
Figure 2:
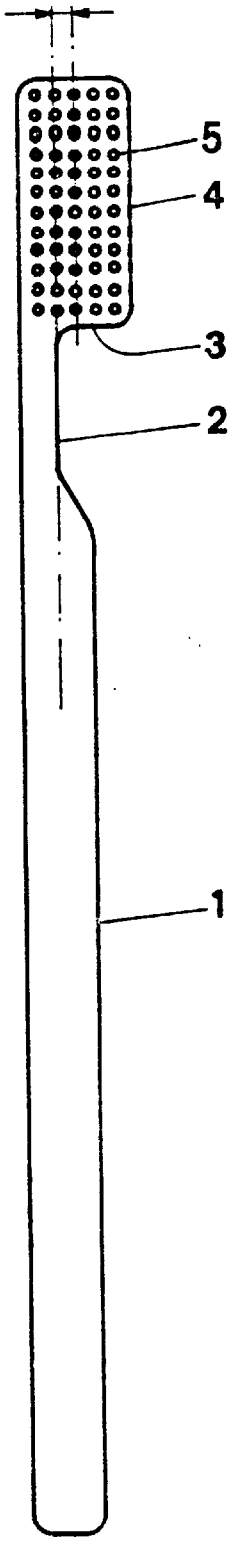
FIG. 2 shows a front view of the toothbrush.

With reference to the numerical references shown in said figures, the toothbrush includes a handle 1 including a recessing portion 2 contiguous to the bristle-carrier zone 4.

A first side of the handle 1 is aligned to the relevant side of the bristle-carrier zone 4, while its second side has an undercut 3 reaching near the axis of said handle and bounding said recessing portion 2, which is 2 or 3 cm. long.

The brush 5 of the toothbrush is obtuse-angle shaped. The bristles of the toothbrush shown by FIG. I are directed upward if said toothbrush is suitable to be used by right-handed persons, downward if said toothbrush is suitable to be used by left-handed persons.

The above description and the enclosed drawings clearly show that the geometric features of said toothbrush, and in particular the misalignment of the bristle-carrier zone 4 to the handle 1 and the recessing portion 2, allow the bristle-carrier zone 4 to be inserted behind the inferior dental arch for effectively cleaning the teeth belonging to said dental arch.

A toothbrush according to the invention is therefore suitable in preventing the formation of dental plaque and of tartar.

I claim:

1. An elongated toothbrush having first and second opposite ends, said toothbrush suitable for preventing the development of dental plaque and of tartar and including at least a bristle-carrier zone providing for a first and a second lateral side, opposite each other with and upper side therebetween having bristles thereon, and a handle, integral to said bristle-carrier zone and providing for first and second parallel lateral sides and for a longitudinal axis, wherein said first lateral side of said bristle-carrier zone protrudes laterally from said handle past said first lateral side of said handle, said second lateral side of said handle being aligned to said second lateral side of said bristle-carrier zone such that said second lateral sides lie in a common plane along the entire length of the toothbrush between said first and second ends, and in that said first lateral side of said handle has an undercut bounding a recessing portion located contiguously to said bristle-carrier zone and in that no recessing portion is provided between said second lateral side of said handle and said second lateral side of said bristle-carrier zone.

2. Toothbrush according to claim 1, characterized in that said undercut reaches said longitudinal axis of said handle.

3. Toothbrush according to claim 1, characterized in that said recessing portion is from 2 to 3 cm. long, beginning from the bristle-carrier zone.

4. Toothbrush according to claim 1, wherein a side of said recessing portion of said tooth-brush is at an obtuse-angle with respect to the longitudinal axis.

5. Toothbrush according to claim 1, which is suitable to be used by right-handed persons, characterized in that the bristles of said bristle-carrier zone are directed upward.

6. Toothbrush according to claim 1, and suitable to be used by left-handed persons, characterized in that the bristles of said bristle-carrier zone are directed downward.

* * * * *